United States Patent [19]

Niezgoda et al.

[11] 4,393,740

[45] Jul. 19, 1983

[54] PROGRAMMABLE TONE GENERATOR

[75] Inventors: Thomas A. Niezgoda, DeKalb; Carl P. Oppenheimer, Sycamore, both of Ill.

[73] Assignee: The Wurlitzer Company, DeKalb, Ill.

[21] Appl. No.: 221,983

[22] Filed: Jan. 2, 1981

Related U.S. Application Data

[63] Continuation of Ser. No. 22,970, Mar. 23, 1979, abandoned.

[51] Int. Cl.[3] ..... G10H 1/00

[52] U.S. Cl. ..... 84/1.01; 84/1.19

[58] Field of Search ..... 84/1.01, 1.03, 1.19; 364/78; 328/16; 307/264, 265, 267

[56] References Cited

U.S. PATENT DOCUMENTS

| | | | |
|---|---|---|---|
| 3,836,858 | 9/1974 | Kitano | 307/265 X |
| 4,001,555 | 1/1977 | Levis et al. | 364/718 |
| 4,099,109 | 7/1978 | Abbondanti | 307/265 X |
| 4,137,810 | 2/1979 | Wheelwright et al. | 84/1.03 |
| 4,141,376 | 2/1979 | Frey | 307/265 X |
| 4,205,574 | 6/1980 | Hoskinson et al. | 84/1.01 |

*Primary Examiner*—J. V. Truhe
*Assistant Examiner*—Forester W. Isen
*Attorney, Agent, or Firm*—Trexler, Bushnell & Wolters, Ltd.

[57] ABSTRACT

A programmable tone generator for an electronic musical instrument generates a tone signal having a desired fundamental frequency and harmonic content. A binary counter serves as a time base for encoding each period of a tone signal waveform onto plural outputs in the form of a binary code. A plurality of programmable tone generation circuits are coupled with selected counter outputs to comprise plural tone signal branches, each providing a tone signal at a selected fundamental frequency and having selected harmonic content. A signal processing circuit associated with each tone signal branch includes a programmable variable code generator and determines the initial content of the output waveform, subsequently either maintaining or changing the fundamental frequency and harmonic content thereof.

8 Claims, 9 Drawing Figures

CLOCK
COUNTER
10
12
14
16
22
BUFFER
20
ADDER
24
ARITHMETIC
26
LEVEL CONTROL
44
46
COMPARATOR
28
30
32
34
CONTROL
FOUT 18a
18b
18c
18d
18e
18f
18
RESET
40
RST
42
38

74
ADD
70
ADD
72
74-8
74-7
74-6
74-5
74-4
74-3
74-2
74-1
26
ROM
50
ROM
52
140
142
30
CTR
54
56
CTR
58
CTR
60
CTR
62
CTR
64
CTR
66
CTR
68
76
82
86
80
78
84
71
69

PULSE OUT
B+
FIN
D
FFQ
CK
R
202
200
210
222
220
224
226
218
212
214
216
228
162
234
232
236

RAM 50,52
CTR
54
DEC
150
152
138
154
76
82
155
156
157
158
159
161
174

D TO A
162
170
172
174
168
166
164
157
159
161
160
30

PROGRAMMABLE TONE GENERATOR

RELATION TO OTHER APPLICATIONS

This application comprises a continuation of application Ser. No. 022,970, filed Mar. 23, 1979 now abandoned.

BACKGROUND OF THE INVENTION

Electrical generation of suitable tone signals in electronic musical instruments has been accomplished in the past by many different arrangements. In recent years, the prevalent practice has been to provide oscillators for separately generating tone signals corresponding to the semi-tones of the top octave of the instrument or above, and providing each oscillator with a chain of divide-by-two circuits to produce the corresponding frequencies (lower order harmonics) in lower octaves of the instrument. This approach of course requires individual tuning of twelve oscillators.

Recent developments in integrated circuit technology have made possible the use of a single high frequency oscillator driving parallel divider circuits each providing a suitable divider ratio to produce one of the twelve frequencies of the top octave of the instrument. These divider chains are then followed by divide-by-two circuits as in the previous example to produce the corresponding frequencies in lower octaves of the instrument. Such circuits are advantageous in requiring tuning of but a single oscillator. However, these circuits have presented problems in obtaining accurate division ratios and suitable waveform symmetry that are difficult and costly to solve.

In both of the foregoing systems, the use of conventional divider circuits results in generation of square waves (ie., 50% duty cycle rectangular waves), thus limiting the harmonic structure of the tone signal at the outputs of such generators to the harmonic spectrum of a square wave. Thus, to obtain other desired musical sounds, it is necessary to provide other circuitry, which is often quite cumbersome and expensive, to modify, combine, reshape and/or filter these waveforms as necessary to produce the desired musical sounds. For example, some systems utilize analog waveshaping techniques to produce harmonically rich waveforms, and then selectively filter these waveforms to approximate the desired harmonic structure of the output waveform. Generally speaking, such analog circuits are subject to problems in maintaining accurate and noise free signals during analog signal processing. Moreover, such analog circuits have generally been cumbersome and expensive, due to the great redundancy of circuits generally required to produce the number of voices required even for a relatively simple instrument.

OBJECTS AND SUMMARY OF THE INVENTION

Accordingly, it is a general object of the present invention to provide a new and improved tone generating method and apparatus for an electronic musical instrument which is capable of producing a tone signal output at a desired fundamental frequency having a desired harmonic content.

A more specific object of the present invention is to provide tone generating method and apparatus for an electronic musical instrument which is programmable for initially determining and thereafter for selectively maintaining or changing the fundamental frequency and harmonic content of the tone signal output thereof.

A related object is to provide a tone generating method and apparatus of the type described which is entirely digital in form, replacing all analog elements of other conventional tone generation methods and apparatus, and which provides a digitally derived signal output which may be applied directly to conventional analog sound reproduction elements.

Briefly, and in accordance with the foregoing objects, a method for tone signal generation according to one aspect of the present invention comprises producing a clock signal at a predetermined frequency, producing an advancing binary encoded count on a plurality of outputs in response to said clock signal, and digitally processing the count at selected ones of said outputs to produce a series of pulse output signals, said digital processing including controlling in a predetermined fashion the width of each said pulse signal produced and the spacings therebetween, thereby producing a composite tone signal of predetermined fundamental frequency and harmonic content.

A tone signal generator according to another aspect of the invention comprises a clock pulse generator, counter means having an input coupled to said clock pulse generator and having output means, at least one digital signal processing circuit coupled to said output means and having a tone signal output which is a composite signal comprising a series of digital signal segments and a programmable variable number source coupled to supply predetermined digital numbers to said digital processing circuit and cooperating therewith to individually control the duration of each of said digital signal segments, thereby constructing said composite signal at a predetermined fundamental frequency and having predetermined harmonic content.

BRIEF DESCRIPTION OF THE DRAWING

The present invention will be more readily understood upon reference to the following detailed description of the illustrated embodiment together with the accompanying drawings, wherein.

DETAILED DESCRIPTION OF THE ILLUSTRATED EMBODIMENT

Figures 1, 2, 3:
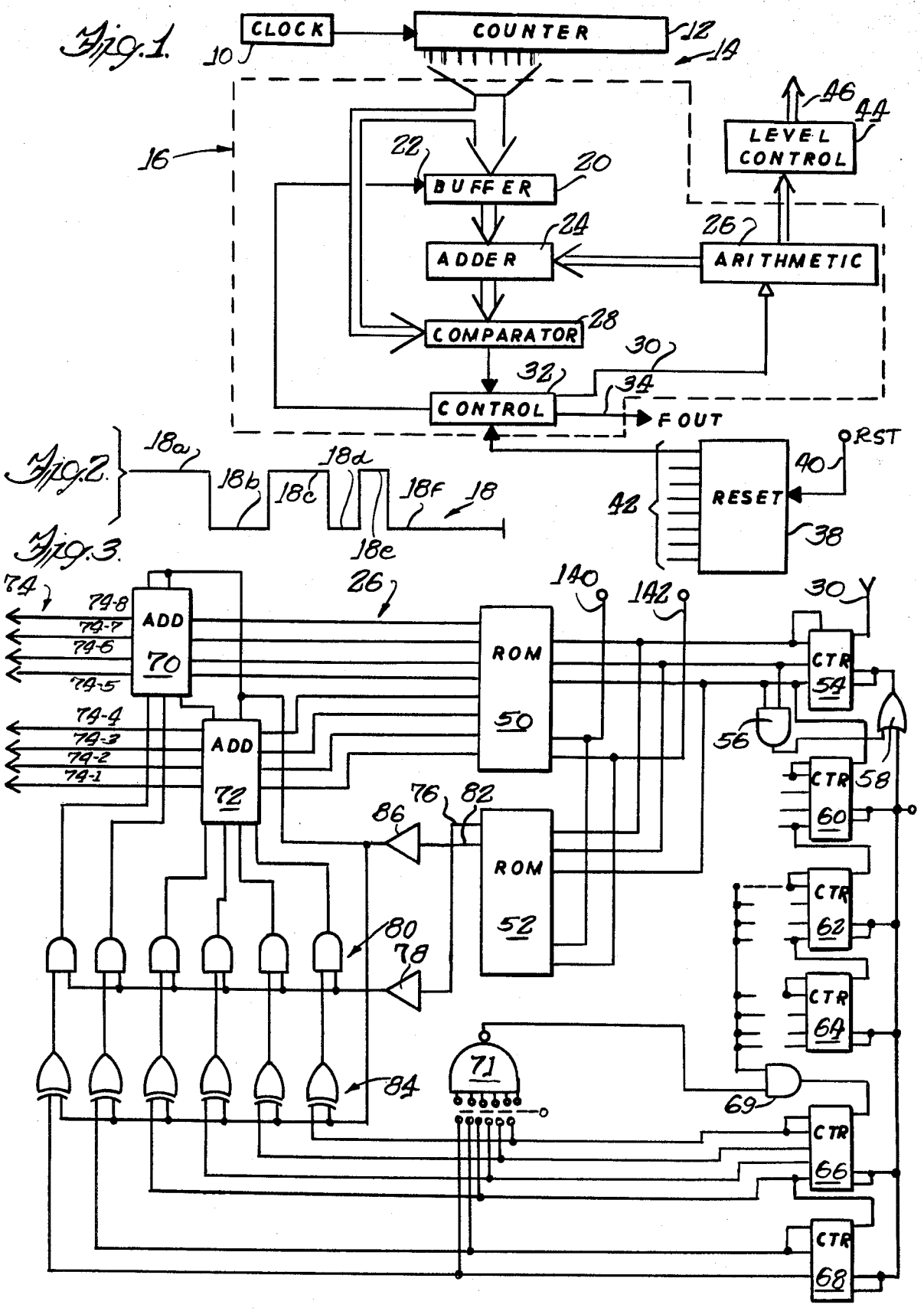
FIG. 1 illustrates, in block diagrammatic form, the novel tone generating circuit of the present invention.
FIG. 2 is a waveform diagram illustrating one form of output signal of the circuit of FIG. 1.
FIG. 3, FIG. 4 and FIG. 5 are circuit schematics illustrating portions of the block diagram of FIG. 1 in additional detail.

In FIG. 1, a novel tone signal generation system in accordance with the present invention is illustrated in block diagrammatic form. Advantageously, the circuit of this invention is capable of generating a composite output signal in the form of a series of pulse signals or a pulse train whose individual sections or segments are controllably varied in width or time duration as well as in amplitude. Accordingly, this composite tone signal output exhibits a desired harmonic content or spectrum. As a further advantage, the circuits of the invention are all in digital logic form, capable of incorporation on a large scale integrated circuit (LSI) chip, utilizing conventional manufacturing techniques, thus enhancing the cost effectiveness as well as the reliability of the system of the present invention.

Initially, FIG. 1 illustrates a clock or high frequency oscillator 10 which presents a suitable high frequency pulse train to a multi-stage binary counter 12, which preferably comprises a eight-bit synchronous binary counter. Accordingly, the counter 12 presents eight bits or binary outputs designated generally 14. In the illustrated embodiment, these counter outputs 14 are utilized to drive eight substantially identical digital processing circuits 16. In order to facilitate the description only one such digital processing circuit 16 is illustrated. Each such digital processing circuit 16 utilizes the eight counter outputs 14.

Each circuit 16 produces a pulse train comprising series of pulse signals, sections or segments, which may take, as one example, the form illustrated in FIG. 2. This series generally designated 18, of pulse signals or segments 18*a*, 18*b*, etc. includes in the illustrated embodiment, six such signals, sections or segments 18*a*, 18*b*, etc. which might be called pulses and spaces. In the illustrated embodiment, the period of the pulse train is variable with a minimum of six and maximum of 512 counts from the clock 10 via the counter 12. As will be seen later, both the width and the amplitude of each of these sections may be varied in accordance with novel aspects of the present invention, thus the designation of "pulse" and "space" of the signal train or series 18 illustrated in FIG. 2 may not be strictly accurate in all cases, whereby the terms "section" or "segment" are frequently utilized hereinbelow. It will also be recognized that the specific example heretofore given is for purposes of illustration only, and is not to be construed as limiting the invention in any fashion.

Referring again to FIG. 1, the digital processing circuit 16 includes a buffer circuit 20 which receives the associated eight output lines 14 of the counter circuit 12. In the preferred embodiment, this buffer circuit 20 comprises a latch, which is controlled at an input 22 thereof for latching or holding the count from the first outputs of the counter 12. The control signal at the input 22 and the time sequence in which it latches the ongoing count from the counter 12 will be described later. The buffer or latch 20 feeds the eight-bit binary signal which has been latched from the counter 12 to an eight-bit adder circuit 24. This adder circuit 24 receives a second eight-bit binary encoded signal from an arithmetic unit 26. The adder 24 functions to sum or add the two eight-bit binary encoded signals at its respective inputs and to produce this sum as an eight-bit binary encoded output feeding one compared input of a comparator circuit 28. The comparator circuit receives as a second compared input, an eight-bit binary encoded signal directly from the same eight outputs 14 of the counter circuit 12 which feed the buffer 20. The comparator 28 compares these two eight-bit binary encoded input signals and produces a control output signal indicating whether or not these two signals are identical. This output control signal feeds a control circuit 32 which responds by providing suitable control signals both for the arithmetic unit 26 (via a line 30) and for the control input 22 of the latch or buffer 20 as will be described in additional detail later herein. The control circuit 32 also produces a resultant or composite tone signal output (F out) on a line 34.

Figure 5:
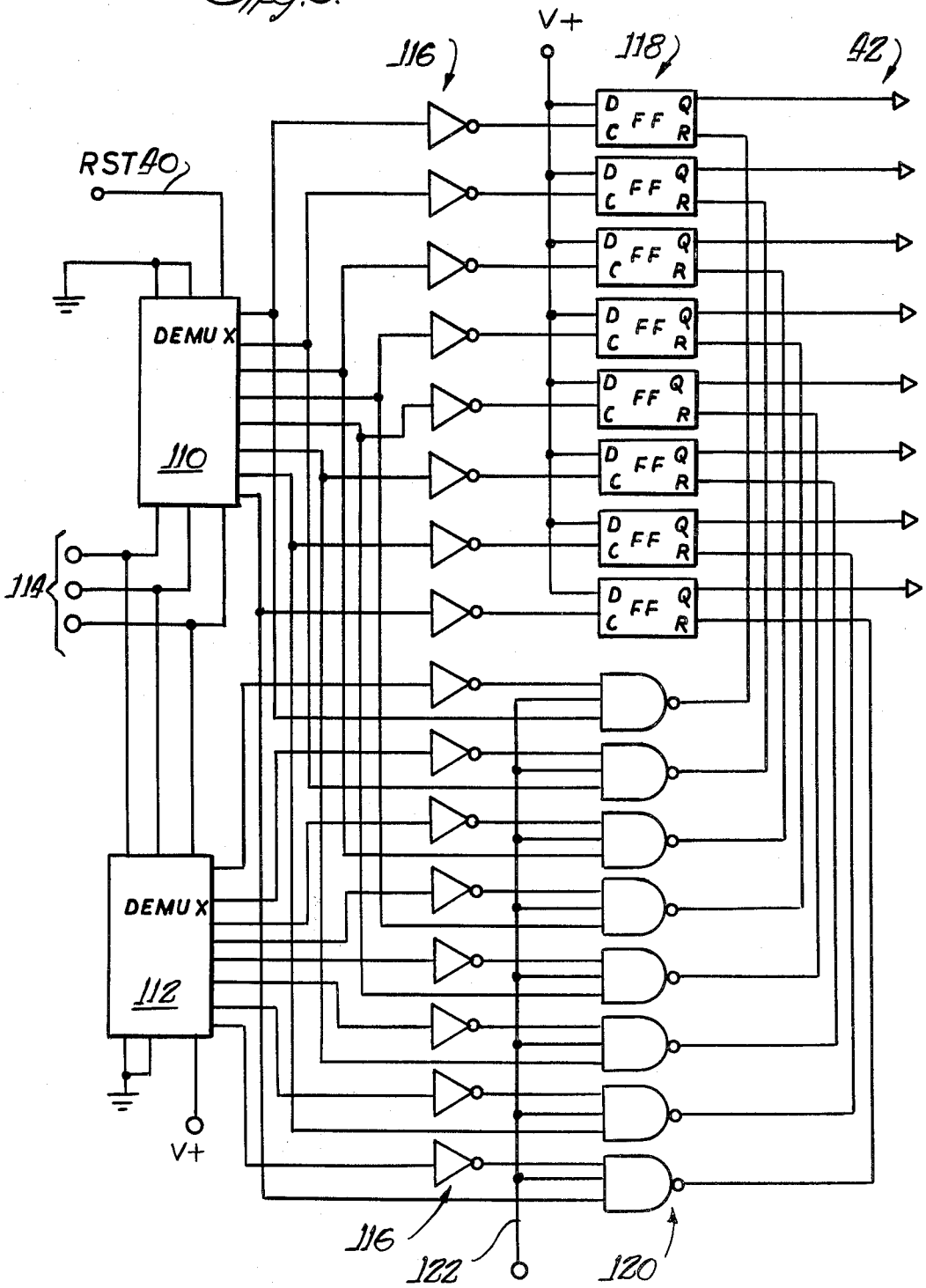

A suitable reset circuit 38, as shown in FIG. 5 and described later, feeds all of the eight like digital processing circuits 16, therefore being illustrated outside of the dashed line. This reset circuit receives a reset signal (RST) at an input line 40, and feeds the reset signal in predetermined sequence to each of eight output lines, designated generally 42, for resetting each of the eight control circuits 32 of the digital processing circuit 16.

In accordance with a further novel aspect of the invention, a pulse height or level control circuit 44 may be utilized to achieve individual control of the level or height of each of the signal sections, e.g. 18*a*, 18*b*, etc. as illustrated in FIG. 2. This circuit 44 receives further outputs of the arithmetic circuit 26 and produces pulse height or level controls signal at an output 46.

It will be constructive to now briefly consider the operation of the present invention with reference to the block diagram of FIG. 1. The arithmetic unit 26 generally comprises a programmable, variable number or code source which outputs a control number or code to the adder 24. The code source stores an initial binary encoded number as an initial control output for each section of the signal to be produced. With reference to the example given in FIG. 2, a separate such initial number or code would therefore be stored in the arithmetic circuit 26 for each segment or section 18*a*, 18*b*, etc. This signal corresponds to the actual number of clock pulses to be counted by the counter 12 for that output signal section. In accordance with an important feature of the invention, these numbers are separately programmable in the arithmetic circuit 26 for each of the digital processing circuits 16, and therefore can be utilized to produce as many different tone signals as there are digital processing circuits 16 in the instrument.

After a desired number of cycles of production or period of time of the pulse series (.e.g, series 18 of FIG. 2) in accordance with the initial control code, which number is also programmed into the arithmetic circuit 26, the binary coded control numbers output by arithmetic unit 26 may be altered, for modifying the next number of cycles accordingly. This alteration is also programmed into each unit 26. It should be recognized in this connection that by cycle is meant a given group or series of digital signals or pulses, the example of FIG. 2 illustrating a cycle or series 18 comprising six such segments or sections. The arithmetic circuit 26 may further be programmed for modifying the binary encoded control number output a given number of times, whereupon a stable state is reached at which the circuit 26 continues to generate a fixed binary encoded signal output, again dependent upon the programming thereof.

Referring now to FIG. 3, the arithmetic unit 26 is illustrated in circuit schematic form. A read only memory (ROM) portion of the circuit comprises two integrated circuit ROM's 50 and 52, which in the illustrated embodiment each comprises an integrated circuit ROM of the type generally designated MM5202A. In the embodiment illustrated in FIG. 3, the ROM 50 is utilized to store six eight-bit words while the ROM 52 is utilized to store up to six two-bit words. Thus, the ROM space utilized in the embodiment illustrated in FIG. 3 comprises six, ten-bit words. The eight bits of each word contained in ROM 50 comprise the binary encoded number or code which determines the duration or width of a respective section of the tone signal output, eg., the widths of sections 18*a*, 18*b*, etc. of the waveform 18 of FIG. 2. The two binary encoded output bits of each word which are stored in the ROM 52 are controls or "flags", utilized, respectively, to indicate whether the section width or duration should be modified in succeeding cycles of the output waveform, and whether it should be increased or decreased.

The ROM's 50 and 52 are addressed by a counter 54 which receives its clock input from the output line 30 of the control circuit 32. This signal and its derivation will be explained in detail hereinafter. Suffice it to say that this signal on the line 30 goes low (ie., logic "0") at the end of each section of the signal output, (eg., sections 18*a*, 18*b*, etc. of the waveform 18 of FIG. 2). The counter circuit 54 is preferably of the type generally designated 74LS93 and is decoded via a suitable logic circuit including an AND gate 56 and an OR gate 58, to count from zero through five. Three similar counter circuits 60, 62 and 64 are interconnected with the counter 54 and with each other, to comprise a counter chain, which provides a clock pulse to a seven-bit counter comprising a pair of further similar counter circuits 66 and 68. In the illustrated embodiment the counters 60, 62, 64, 66 and 68 are all integrated circuits of the type generally designated 74LS93. The counters 62 and 64 together comprise a programmable counter for preselecting the number of counts therefrom necessary to provide each clock to the counter 66. This programming or preselection is accomplished by providing a suitable jumper between a selected output of counters 62 and 64 and one input of a two-input AND gate 69 which feeds the clock input of the counter 66. The other input of the AND gate 69 is fed from the output of a six-input NAND gate 71, which is utilized to provide a maximum count lock-out. The inputs to the NAND gate 71 are also programmed by being selectively jumpered with the outputs of the counters 66, 68, thereby programming the maximum count for lock-out. This process also allows the number of pulse pattern changes available for each such circuit 16 to be pre-programmed into the circuit. The invention is not limited, however, to such a counter chain since other circuits may be utilized to perform this function. For example, an asynchronous oscillator circuit (not shown) might be arranged to provide an adjustable period for controlling these pulse pattern changes.

It will be appreciated from the foregoing that each of the circuits 16 may be individually programmed to achieve the desired pattern of output pulses. Advantageously, the novel yet simple expedient of separately programming the respective ROM's 50 and 52, as well as the counters 62, 64, 66 and 68 is all that is required. In all other respects, the remaining portions of the arithmetic unit circuit 26, and all other components, are identical for each digital processing circuit 16.

In operation, the six-bit output of the counters 66 and 68 are utilized to provide a number, programmed as described above, which is either added to or subtracted from the eight-bit ROM number at the output of the ROM 50. This addition or subtraction is carried out by a pair of four-bit adders 70, 72, which receive one set of inputs to be added from the ROM 50 directly, and receives the other set of inputs to be added from the six-bit counters 66, 68 via suitable intervening logic. The adders 70 and 72 output an eight-bit signal comprising the sum of these two signals on eight output lines designated generally 74 (and separately designated 74-1, 74-2, 74-3, 74-4, 74-5, 74-6, 74-7, 74-8).

The decision as to when and how to modify the eight-bit output of the ROM in the adders 70, 72 is also programmed into ROM 52. As mentioned briefly above, one bit output ROM 52 determines whether or not the count from the counters 66, 68 will be fed through to the adders 70, 72, to combine with the output of ROM 50. In the illustrated embodiment, this is output 76 of ROM 52 and is connected via a suitable buffer 78 to one input of each of a plurality of two-input AND gates designated generally 80, the other input of each of these AND gates 80 being joined with a respective output of a group of exclusive OR gates 84.

The remaining bit output of the ROM 52 controls whether the six-bit signal from the counter 66, 68, once allowed in accordance with the state of the bit output 76, will be added or subtracted, at the adders 70 and 72, to the eight-bit signal from ROM 50. This control bit is output 82 and feeds one input of each of a plurality of two-input exclusive OR gates designated generally 84, via a suitable buffer 86. The other inputs of these exclusive OR gates 84 are fed from the respective outputs of the previously described counters 66 and 68. From the foregoing it will be seen that when the bit output 76 of ROM 52 is high, the six-bit signal from counters 66 and 68 will be allowed at the adders 70 and 72 and conversely, when the bit 76 is low, these same signals will be inhibited. When the bits 76 and 82 of ROM 52 are both high, the six-bit output of the counter 66 and 68 will be subtracted from the eight-bit output of ROM 52 by the adders 70 and 72, while if bit 82 is low, the six-bit number will be added to the eight-bit number. When the bit 76 is low, all zeros will be presented at those inputs of the adder 70 and 72 normally receiving the six-bit output of counter 66 and 68, whereby the eight-bit output of ROM will be reproduced unaltered at the output 74. The foregoing may of course be achieved as desired by programming the bits 76 and 82 accordingly. In the illustrated embodiment, the circuit of FIG. 3 effects at most a one-bit change in the output signal 74 per segment, per cycle of the tone signal output, it being remembered that one cycle in the illustrated embodiment comprises six segments or sections, with reference to FIG. 2.

Figure 4:
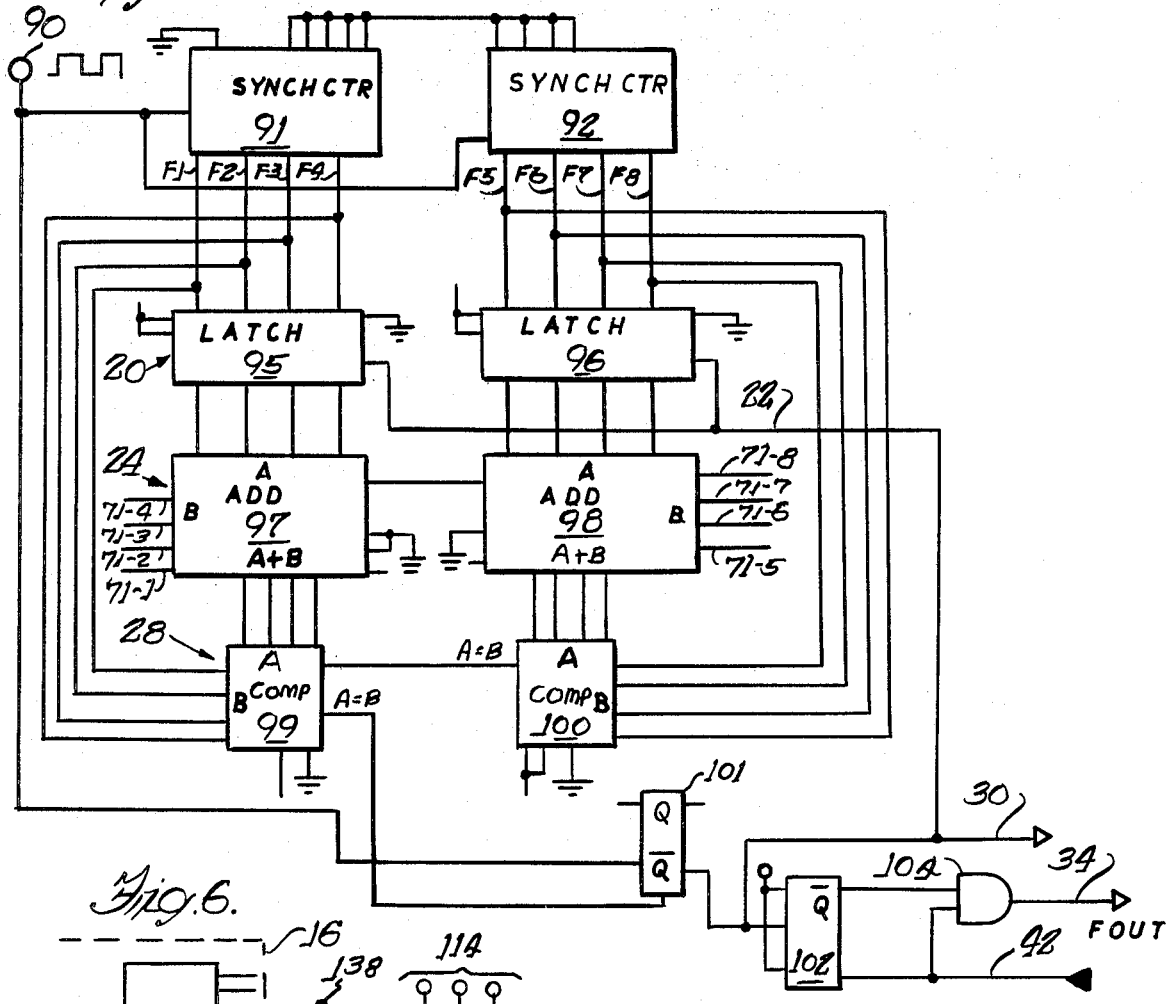

Referring now to FIG. 4, the remaining elements of the digital processing circuit 16 are illustrated, together with the counter 12 and an associated clock 90. The clock 90, in the case of the first of the processing circuits 16 is the clock or external oscillator 10. This oscillator 10 as previously mentioned, outputs a square wave pulse train at a fixed frequency, which in the illustrated embodiment, is on the order of 1.7 megahertz. The counter 12, in the illustrated embodiment, comprises two, four-bit synchronous counter circuits 91, 92 and interconnected to form an eight-bit synchronous counter. The outputs of the synchronous counter feed the illustrated first signal processing circuit 16 comprise the four output bits (F1, F2, F3, F4) of the counter circuit 91 and the four bits (F5, F6, F7, F8) of the counter circuit 92. In the illustrated embodiment, the counter circuits 91 and 92 comprise integrated circuits of the type generally designated 74LS161.

The buffer 20 comprises a pair of four-bit latch circuits 95 and 96, which have their input terminals joined with the respective outputs of the counters 91 and 92. The load control input line 122 of the latches is fed from the control circuit 32, as mentioned previously. The output lines of the latches 95 and 96 also comprise four bits each and feed respective input terminals (A) of two four-bit adders 97 and 98, which form the adder circuit 24 of the block diagram of FIG. 1. These adders 97, 98 receive at their other inputs (B) the output lines 74 from the adders 70, 72 of the arithmetic circuit 26 of FIG. 3 as designated by the use of the like reference numerals 71-1 through 71-8. The adder circuits 97 and 98 preferably comprise integrated circuits of the type generally designated 74LS83, while the latches 95 and 96 preferably comprise integrated circuits of the type generally designated 74LS95.

The summed outputs (A+B) of the adders 97 and 98 comprise four-bit outputs which feed corresponding four-bit input terminals (A) of a pair of four-bit comparators 99 and 100, which comprise the comparator 28 of the block diagram of FIG. 1. The other compared inputs (B) to the comparators 99 and 100 are the four-bit counter outputs of the counters 91 and 92, respectively. The compare output (A=B) of comparator 100 is fed as an input to comparator 99 whose compare output (A=B) forms the input to control circuit 32.

The control circuit 32 comprises a pair of flip-flops 101 and 102 and an AND gate 104. The comparator 99 output line (A=B) feeds the clear input of flip-flop 101, whose clock input is fed directly from the clock 90. The $\overline{Q}$ output of flip-flop 101 comprises the output line 30 for this circuit 32, which is the same control line feeding the clock input of the counter 54 of FIG. 3, and the clock input for flip-flop 102 whose clear input is driven from the first reset line 42 of the block diagram of FIG. 1. The Q output of flip-flop 102 forms one input to the AND gate 104 whose other input is tied to the same reset line 42. The output of AND gate 104 forms the tone signal output (F out) on line 34 of the digital processing circuit 16.

With reference to FIG. 5, the Reset circuit 38 of the block diagram of FIG. 1 is illustrated in detail, whereby the derivation of the reset signal on lines 42 will now be described in detail. The reset circuit 38 includes a demultiplexer circuit comprising a pair of three-line-to-eight-line demultiplexers 110 and 112. In the illustrated embodiment, the demultiplexers 110 and 112 are integrated circuits of the type generally designated 74LS138. An externally generated, multiplexed reset signal (RST) feeds the input line 40 to the circuit, which becomes a first enable signal of the demultiplexer 110. Select inputs of the demultiplexers 110 and 112 are fed in common from three lines designated generally 114 which are provided with suitable external timing signals, in synchronization with the multiplexing of the reset signal (RST) at the line 40. The unselected outputs of demultiplexers 110 and 112 remain high, while selected outputs go low.

The eight outputs of demultiplexers 110 and 112 each drive the input of one of sixteen inverters designated generally 116. The inverters 116 associated with the outputs of the demultiplexer 110 each feed the clock (C) input of one of a corresponding plurality of flip-flops designated 118. The inverters 116 associated with the outputs of the demultiplexer 112 each feed one input of one of a corresponding plurality of three-input NAND gates designated generally 120. The second input of each of the NAND gates 120 is fed directly from a respective output of the demultiplexer 110, while the third inputs thereof are all tied in common to a control signal line 122. This control signal on line 122 comprises a sample pulse occuring during the last quarter of each multiplexing clock cycle (i.e., the cycle in which the multiplex clock control signals are given over the lines 114). It will be understood that these multiplex signals and control lines are for use with an electronic musical instrument which utilizes multiplexing and demultiplexing circuits, and is provided with common control signals therefore to assure proper synchronization between the operations of the various related multiplexed and/or demultiplexed circuits. Such multiplexing and demultiplexing components form no part of the present invention, however, and therefore need not be described in detail.

The outputs of the NAND gates 120 feed respective reset (R) inputs of the flip-flops 118. The Q outputs of the flip-flops 118 form the respective reset lines 42 for the eight circuits 16. In the illustrated embodiment the lines 114 present a binary encoded count which advances at a 30 Khz rate.

Figure 6:
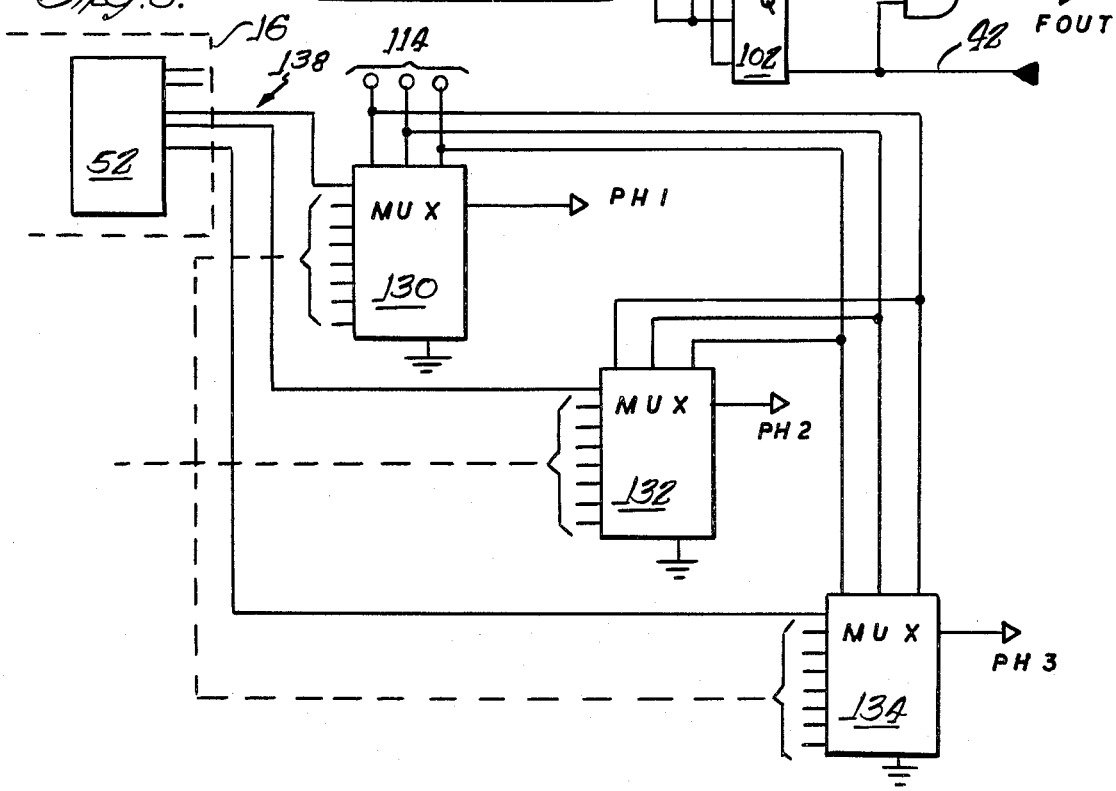
FIG. 6 illustrates an addition to the circuit of FIG. 1, in accordance with a further aspect of the present invention.

Referring now to FIG. 6, the pulse height or level control circuit 44 is illustrated. This circuit 44 comprises three multiplexer circuits 130, 132, and 134, which in the illustrated embodiment are all of the type generally designated 74151. These multiplexers have respective output select inputs driven in common from the three control lines designated generally 114, which are the same lines 114 associated with the circuit of FIG. 5. It will be recognized that these three lines present three bits of multiplexing and demultiplexing information, suitable for handling the eight data processing circuits 16 of the illustrated embodiment. The multiplexed inputs of multiplexers 130, 132 and 134 are provided in serial fashion from the respective ROM 52 in each of the data processing circuits 16. In order to accommodate the pulse height adjusting feature, the utilization of these ROMs 52 is increased by three bits, thereby providing for programming of eight possible amplitude levels. These three additional bits are generally designated 138, only one such ROM 52 and its bit outputs 138 being illustrated to facilitate clarity in the drawing.

Referring again briefly to FIG. 3, a further optional feature comprises external selection of pulse patterns. To this end, a pair of terminals 140, 142 are joined with respective additional address inputs of each of the ROMs 50 and 52. These additional address lines are wired in common to the ROMs 50, 52 for each of the eight digital processing circuits 16. The lines 140, 142 directly join external selection means such as a suitable switch, or the like, for selecting additional words programmed into the ROMs 50, 52 responsive to these two address inputs.

Figure 7:
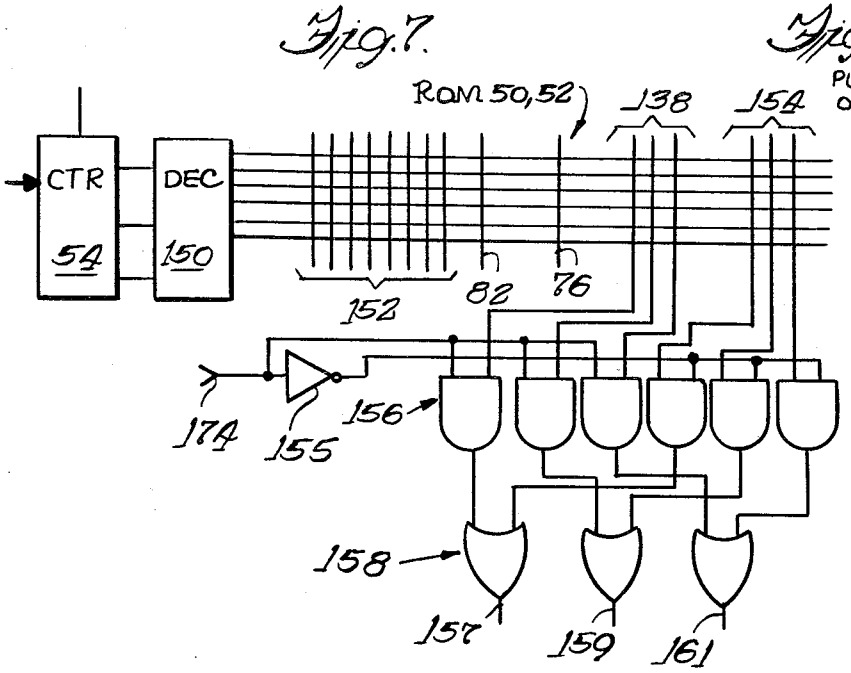
FIGS. 7 and 8 are circuit schematics illustrating further additions to the circuits of the preceeding figures, in accordance with further aspects of the invention.
Figure 8:
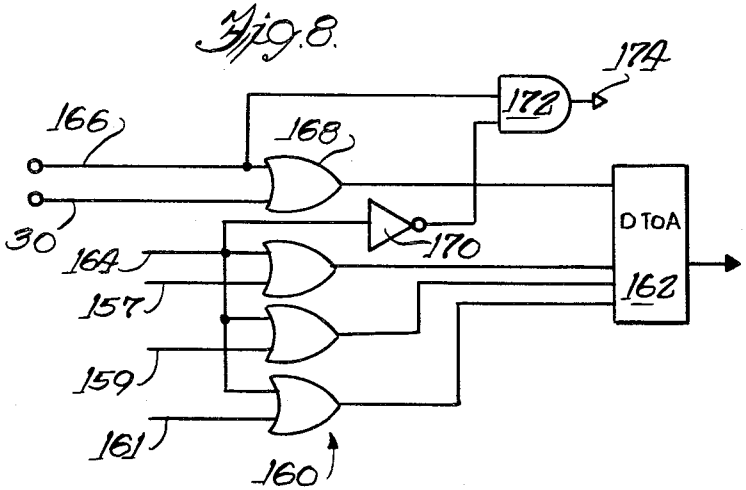

Reference is now invited to FIG. 7 and FIG. 8, wherein additional control circuits, which may be associated with each data processing circuit 16 of the block diagram of FIG. 1, are illustrated. The ROMs 50 and 52 are shown in FIG. 7 as a decoder and a matrix array associated with the counter 54 of FIG. 3. It will be remembered that each ROM 50, 52 may be programmed with six, eight-bit words for each processing circuit 16. Accordingly, the matrix array of FIG. 7 illustrates six, sixteen-bit words, representing the contents of both ROMs 50 and 52 for one processing circuit 16. The ROMs 50 and 52 are provided with a three-line-to-six-line decoder circuit 150, which receives the count from counter 54 and decodes into six lines for selectively addressing one of the six words of the ROM 50, 52.

As described above, the first eight bits, here designated generally 152 provide "transition time" or signal segment width information to the adder 70, 72 of FIG. 3. The next two bits 76 and 82 are the same as like numbered bits of ROM 52 in FIG. 3, providing the "change or maintain" information and the "add or subtract" information to the other circuits of FIG. 3. The next three bits are the bits 138 containing pulse height or level information, as described above with reference to FIG. 6. The remaining three bits, designated generally 154, may be selectively utilized to program other suitable information for the tone signal segments associated with these six words of ROMs 50 and 52.

A digital logic control circuit is provided for utilizing the bits 138 and 154 in conjunction with a mode and enable control circuit illustrated in FIG. 8. The logic control circuit of FIG. 7 comprises an array of six two-input AND gates designated generally 156 each having one input tied to a respective one of the ROM bits or output lines 138 and 154. The second inputs of the last three AND gates 156, as viewed from left to right in FIG. 7, are fed from the output of an inverter 155, while the second inputs of the remaining three AND gates 156 are fed the opposite sense signal taken at the input of inverter 155. The outputs of the first three AND gates 156 are fed to one input of each of three, two-input OR gates designated generally 158, which receive their second inputs from the respective outputs of the remaining three AND gates 156.

Referring now to FIG. 8, outputs 157, 159 and 161 of the three OR gates 158 of FIG. 7 feed one input each of three OR gates designated generally 160. These three OR gates 160 feed the three inputs of a three-bit digital-to-analog converter 162, thereby converting to analog form the digitally encoded pulse height or level signals carried in the ROMs 50, 52. The remaining inputs of the three OR gates 160 are fed in common from a control input 164. The mode and enable control circuit of FIG. 8 receives a second control input on a line 166, which feeds one input of a further two-input OR gate 168, whose opposite input is fed by the control line 30 from the flip-flop 101 of FIG. 4. The control input 164 also feeds an inverter 170 which in turn feeds one input of a two-input AND gate 172, whose other input is fed directly from the control input 166. The output 174 of AND gate 172 feeds the input of the inverter 155 of FIG. 7. The output of OR gate 168 feeds a reference input of the three input D-to-A converter 162.

In operation the control inputs 164 and 166 are connected with control switches or other suitable control signal sources for receiving logic "1" or "0" signals to cause the circuits of FIGS. 7 and 8 to control the output pulses or tone signal segments in accordance with three possible modes of operation. With both inputs 164 and 166 at logic "0", the foregoing circuits will allow variation in segment width of all segments, e.g., 18*a*, 18*b*, etc. of FIG. 2, and in level or amplitude of alternate segments, e.g., segments 18*a*, 18*c*, and 18*e* of FIG. 2. With input 166 at logic 0 and input 164 at logic 1, segment width of each segment of the signal, e.g., segments 18*a*, 18*b*, etc. of FIG. 2, is variable. With input 166 at logic 1 and input 164 at logic 0 both width and level or amplitude of each segment of the output tone signal is variable.

Figure 9:
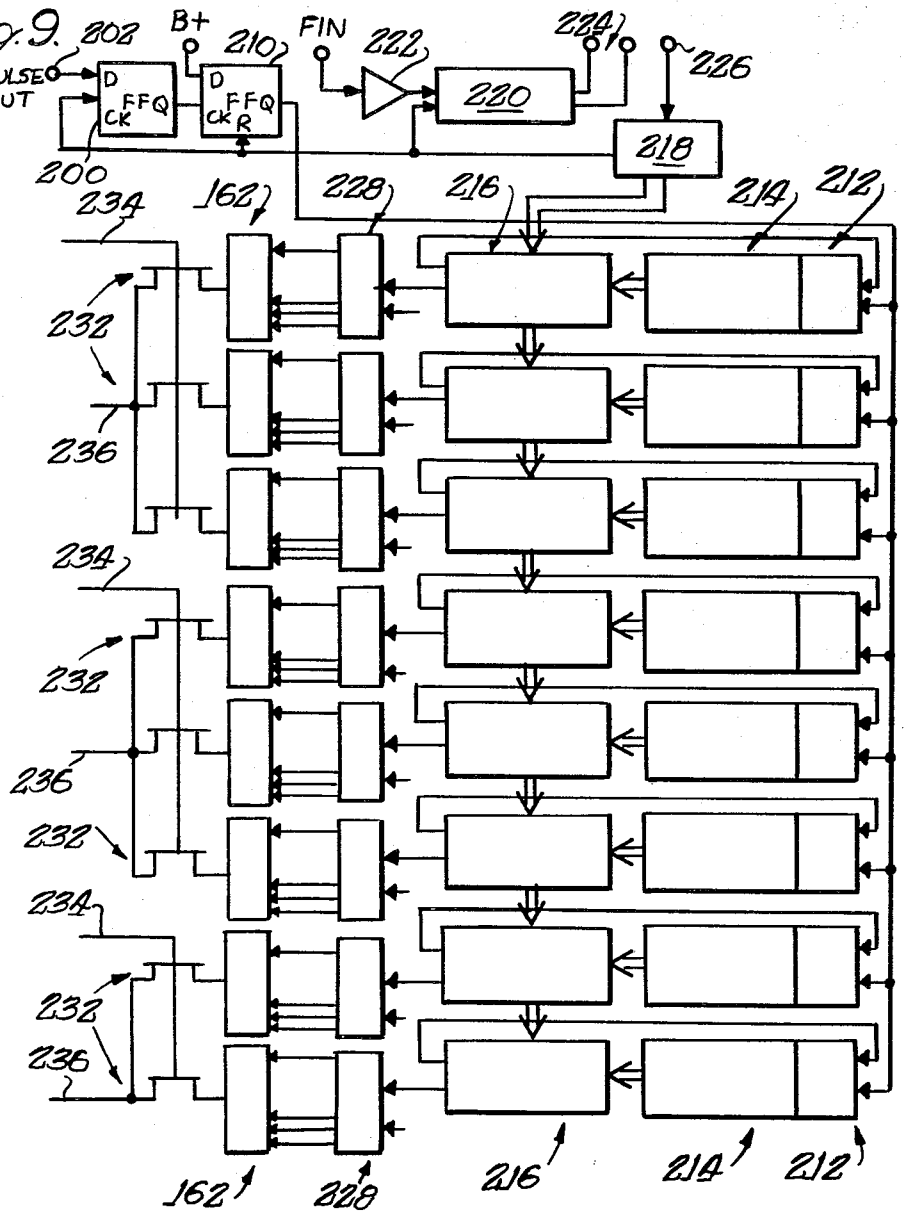
FIG. 9 is a circuit schematic, partially in block form, illustrating an alternate form of a tone generating system in accordance with the principles of the present invention.

Reference is now invited to FIG. 9, which shows a system incorporating eight separate notes or tone signals generated in accordance with the present invention on one LSI circuit chip. The circuit of FIG. 9 makes use of eight each of the components thus far described with reference to FIGS. 3, 4, 7 and 8, which are here each illustrated in block diagrammatic form. Several additional suitable control circuit elements are included to facilitate the incorporation of these eight similar circuits in one integrated circuit package.

These additional components comprise a pair of flip-flops 200 and 210, the flip-flop 200 receiving its D input from a "pulse out" signal terminal 202. This pulse out signal terminal 202 and the signal provided thereat form no part of the present invention and need not be described herein in detail. Suffice it to say, that a pulse signal will be developed at the pulse out terminal 202 in response to each actuation of a key on a keyboard of the associated electronic musical instrument. The Q output of the flip-flop 200 feeds the clock (CK) input of flip-flop 210, whose Q output in turn feeds the reset terminals of each of eight counter circuits, designated generally 212. These counter circuits 212 are each a counter chain similar to that comprising counters 54, 60, 62, 64, 66 and 68 illustrated in FIG. 3. Each counter 212 is associated with an arithmetic circuit and ROM's designated generally 214, each of which is similar to the remainder of the circuit illustrated in FIG. 3. The arithmetic circuits and ROM's 214 in turn each feed a transition circuit designated generally 216, each of which is the same as the circuit of FIG. 4, excluding the counters 80, 82, 84 and 86. These counters are replaced in the embodiment of FIG. 9 by a single eight-bit counter 218. The eight-bit counter 218 also drives the clock input of the flip-flop 200 and the reset input of the flip-flop 210.

An additional circuit in the embodiment of FIG. 9 comprises a frequency and phase detector 220, which has one input fed from the eight bit counter 218 and a second input fed by a frequency signal (F in) from the electronic musical instrument via a suitable buffer 222. The outputs of the frequency detector may be connected to suitable external circuit elements (eg., filters) for use as desired, at terminals designated generally 224. The input to the eight bit counter 218 is from a suitable external oscillator (eg., a VCO) at a terminal 226. The period transition circuits 216 and additional bits of ROM information from the circuits 214 feed respective mode select and enable circuits, designated generally 228. These circuits 228 are each the same as circuits illustrated in FIG. 7 and FIG. 8. The interconnections of these circuits 228 with their associated period transition circuits 216 and ROMs in block 214 are the same as those described with reference to FIGS. 7 and 8. A separate D-to-A converter 162 is provided for each note or tone signal output, and each has its output, designated generally 230 tied to a suitable circuit for envelope control, such as FET's designated generally 232.

A suitable envelope control signal is provided at the gate electrode of each FET 232 from an external source 234. Accordingly, the envelope output signal appears at the opposite terminal of FET 232 at the circuit point designated 236. In the illustrated embodiment, the envelope control signals are applied to the outputs of the tone generation circuits in groups of three, three and two, viewed from top to bottom. Other enveloping arrangements may be utilized, the foregoing forming no part of the invention but serving merely to give an example of a circuit embodying the present invention and including enveloping control.

While preferred embodiments of the invention have been illustrated and described herein the invention is not limited thereto. On the contrary, various modifications, changes and alternatives may occur to those skilled in the art, and the invention includes such changes, modifications and alternatives insofar as they fall within the spirit and scope of the appended claims.

The invention is claimed as follows:

1. A digital electronic tone signal generating circuit for an electronic musical instrument comprising: a clock, digital counter means having an input connected to said clock and having a plurality of outputs, a plurality of like tone signal branches each comprising a digital signal processing circuit including buffer means connected to selected ones of said counter outputs, adder means connected to said buffer, programmable variable number source means connected to said adder, comparator means connected to said adder and also to said selected counter outputs, and flip-flop means connected to said comparator and controlled thereby to produce either a logic 1 or logic 0 output, said selected counter outputs and said programmable variable number source means cooperating for controlling the state of said flip-flop means to construct a rectangular wave output of selected pulse width and pulse spacing in each tone signal branch, thereby comprising a composite tone signal of selected fundamental frequency and harmonic content for each tone signal branch, wherein said programmable variable number source means comprises means providing programmed fixed numbers, programmable means for generating further numbers and means for selectively adding said further numbers with said fixed numbers.

2. A digital electronic tone signal generating circuit according to claim 1 wherein said buffer means comprises a latch circuit and further including a feedback circuit from said comparator means to said latch circuit for controlling the operation thereof.

3. A digital electronic tone signal generating circuit according to claim 1 wherein said programmable variable number source includes at least one ROM.

4. A digital electronic tone signal generating circuit according to claim 1 further including means for generating a level control signal indicative of a desired level for each pulse and each space between pulses in said rectangular wave output.

5. A programmable tone generator comprising a digital signal processing circuit having a tone signal output which is a composite signal comprising a series of digital signal segments, and a programmable variable number source coupled to supply predetermined digital numbers to said digital processing circuit and cooperating therewith to individually control the duration of each of said digital signal segments, thereby constructing said composite signal at a predetermined fundamental frequency and having predetermined harmonic content, wherein the programmable variable number source comprises a ROM providing a first digital number and a programmable counter circuit providing a second digital number and means for selectively passing said first digital number or adding said first and second digital numbers to provide the predetermined digital numbers supplied to said digital processing circuit.

6. A programmable tone generator according to claim 5 further including counter means driven from said digital processing circuit for addressing said ROM.

7. A programmable tone generator according to claim 5 including a plurality of like digital processing circuits and a plurality of independently programmable variable number sources each coupled to one of said digital processing circuits.

8. A programmable tone generator according to claim 5 further including means for providing a control signal indicative of a desired amplitude for each digital signal segment.

* * * * *